United States Patent [19]

Asari et al.

[11] 4,444,039

[45] Apr. 24, 1984

[54] DIE FORGING PRESS

[75] Inventors: Akira Asari, Osaka; Toshio Kurosaki, Akashi, both of Japan

[73] Assignee: Kabushiki Kaisha Kobe Seiko Sho, Kobe, Japan

[21] Appl. No.: 371,921

[22] Filed: Apr. 26, 1982

[51] Int. Cl.[3] ..... B21D 37/16

[52] U.S. Cl. ..... 72/342; 72/448

[58] Field of Search ..... 72/342, 446, 447, 448

[56] References Cited

U.S. PATENT DOCUMENTS

| | | | |
|---|---|---|---|
| 3,422,660 | 1/1969 | Countess | 72/448 |
| 3,427,855 | 2/1969 | Michelson | 72/448 |
| 3,698,219 | 10/1972 | Moore | 72/342 |
| 3,841,142 | 10/1974 | Aisuta | 72/448 |
| 4,088,000 | 5/1978 | Tomioka | 72/446 |

*Primary Examiner*—Gene P. Crosby

*Attorney, Agent, or Firm*—Oblon, Fisher, Spivak, McClelland & Maier

[57] ABSTRACT

A die forging press which includes a press machine proper adapted to detachably mount a die set having an upper die and a lower die; an auxiliary station having a die opening mechanism for holding and moving the upper and lower dies of the die set toward and away from each other and a heater having a heating head retractably protrudable to a position between the upper and lower dies when opened by the die opening mechanism. A transfer mechanism for transferring a die set between the press machine and auxiliary station is provided.

2 Claims, 3 Drawing Figures

DIE FORGING PRESS

BACKGROUND OF THE INVENTION (1) Field of the Art

This invention relates to a die forging press.

(2) Description of the Prior Art

As is well known in the art, dies need to be preheated in hot forging, especially in precision die forging which employs dies of relatively large volumes as compared with the size of the products. Normally, a die set is assembled outside a press machine and heated from its outer periphery in that state before setting the same on the press machine, controlling its temperature such that it will retain an appropriate temperature on the press machine.

In the die forging operation, it is required to maintain an appropriate temperature at those die portions which contact the forging material and particularly at those portions proximate to the opposing meeting faces of the upper and lower dies. Therefore, the above-mentioned conventional method of heating the upper and lower dies in an assembled state necessarily involves the heating of those die portions which do not need to be heated to the appropriate die temperature, resulting in a low heating efficiency and a large energy loss. Moreover, there has been a strong demand for improvement of the working conditions so as to minimize the hot and heavy labor which has thus far been required for transferring and mounting the heated dies on the press machine.

On the other hand, in order to replace the dies in a prompt and accurate manner, the best method is to assemble the upper and lower dies outside the press machine and to bring them into the machine in that state. However, this provokes an antinomy against the above-mentioned problem of economical heating which necessitates opening of the dies for heating the die portions which need heat control.

SUMMARY OF THE INVENTION

With the foregoing in view, the present invention has as its object the provision of a die forging press which is capable of opening and re-aligning preset upper and lower die members for positive and direct heating of center die portions which actually need heating, thereby attaining higher energy savings and heat efficiency while enhancing the operational accuracy of the press by reducing the adverse thermal effect on the component parts of the press.

It is another object of the present invention to provide a die forging press employing a transfer means for transferring a preheated die set to and from the press machine, obviating the hot and heavy labor as required in the conventional operations.

According to the present invention, there is provided a die forging press comprising a press machine properly adapted to detachably mount a die set including an upper die and a lower die an auxiliary station having a die opening mechanism for holding and moving the upper and lower dies of the die set toward and away from each other and a heater having a heating head retractably protrudable to a position between the upper and lower dies when opened by the die opening mechanism and transfer means for transferring a die set between the press machine and auxiliary station.

The above and other objects, features and advantages of the present invention will become apparent from the following description and the appended claims, taken in conjunction with the accompanying drawings which show by way of example preferred embodiments of the invention.

DETAILED DESCRIPTION OF THE PREFERRED EMBODIMENTS

Figure 1:
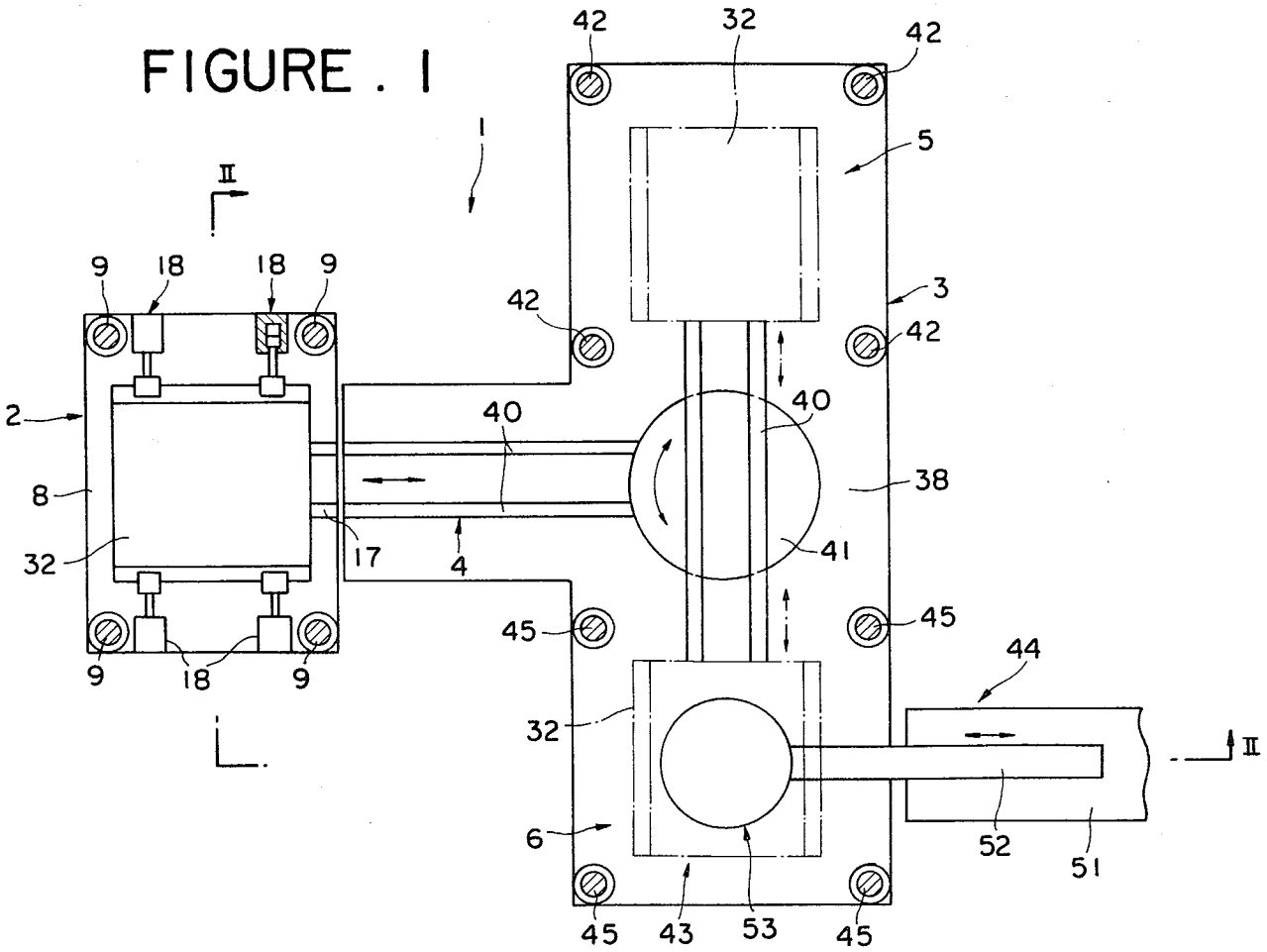
FIG. 1 is a plan view of a die forging press according to the present invention.
Figure 2:
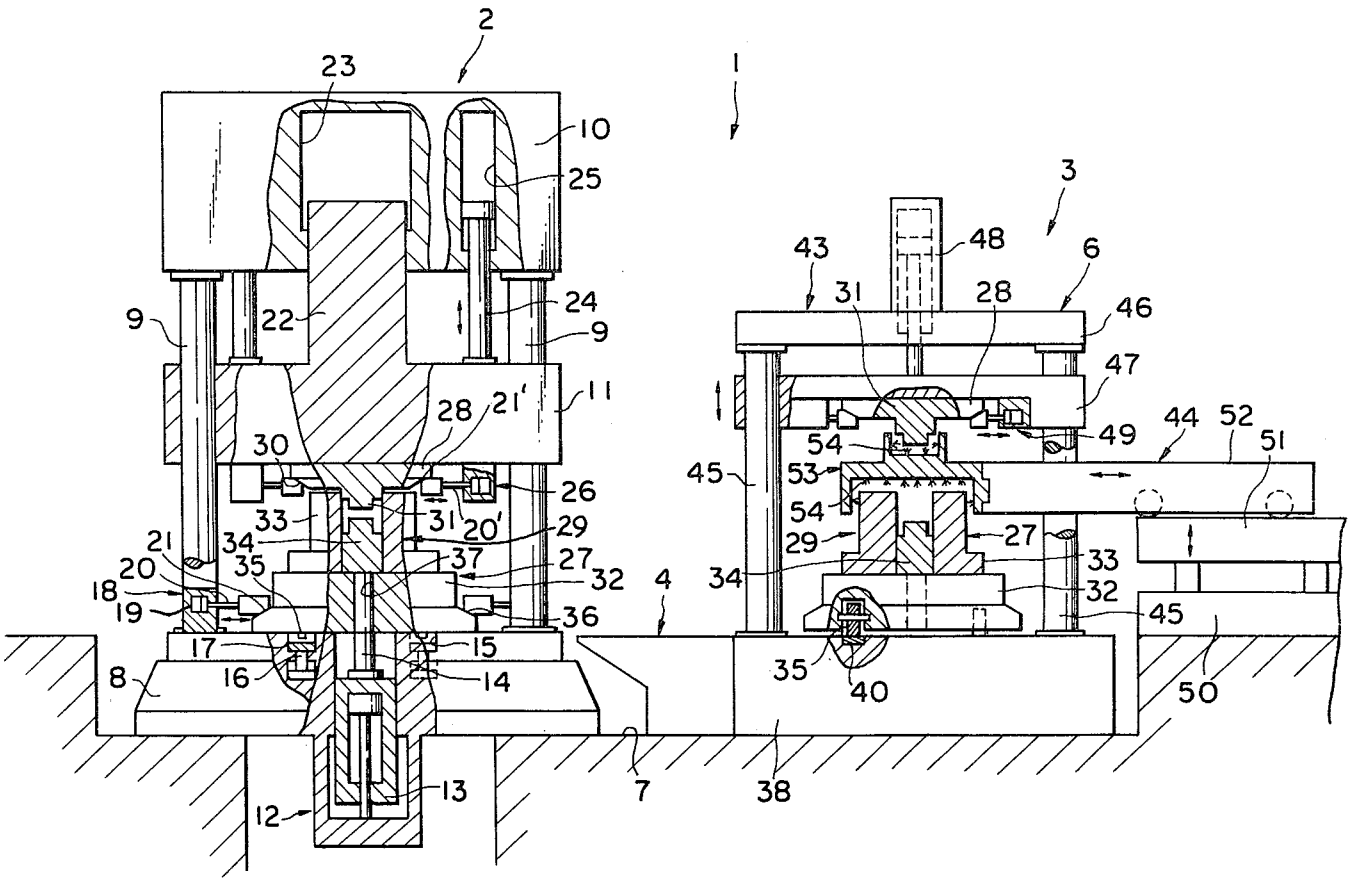
FIG. 2 is a side elevation of the same press, partly sectioned on line II—II of FIG. 1.

Referring to the accompanying drawings and first to FIGS. 1 and 2, there is shown a die forging press 1 according to the present invention, which includes a press machine proper 2, an auxiliary station 3, and a transfer mechanism 4. The auxiliary station 3 is provided with a die setting section 5 and a die heating section 6. The transfer mechanism 4 which connects the press machine proper 2 with the die setting and heating sections 5 and 6 is built into the auxiliary station in the particular embodiment shown.

In FIG. 2, there is shown by way of example a vertical type hydraulic press 2 which of course can be replaced by a mechanical press or other press machines if desired. The exemplified press machine 2 has four guide posts 9 erected on a die base 8 which is placed on a floor 7. A crosshead 10 which is securely mounted on the head portions of the guide posts 9 supports a punch holder 11 slidably vertically along the guide posts 9 between the crosshead 10 and the die base 8. A knockout mechanism 12 which is built into the center portion of the die base 8 is provided with a knockout rod 14 which is retractably projected above the upper surface of the die base 8 by a knockout cylinder 13. A number of cylinder rods 16 are retractably projected through the bottom walls of a pair of parallel grooves 15 which are formed on the upper side of the die base 8. Fitted in each groove 15 is a rail member 17 which is movable up and down by extension and retraction of the cylinder rods 16. Further, a clamp mechanism 18 is provided on the die base 8, including a pair of clamp cylinders 19 which are securely mounted in laterally opposing positions on the die base 8. The clamp cylinders 19 have clamp rods 20 which are movable horizontally toward and away from each other and provided with a tapered portion 21 at the respective fore end portions.

A piston 22 which is formed integrally with and projected upwardly from the center of the punch holder 11 is slidably fitted into a main cylinder 23 which is provided in the crosshead 10. Further provided in the crosshead 10 are lifting cylinders 25 with the lower ends of the respective piston rods 24 securely connected to the upper side of the punch holder 11. On the underside of the punch holder 11, there is provided a clamp mechanism constituted by a pair of clamp cylinders 26 which are disposed parallel with the upper surface of the die base 8 and in laterally opposing positions similarly to the clamp mechanism 18 on the upper side of the die base 8.

A die set 27 which is detachably fixed on the die base 8 and punch holder 11 consists of an upper die 28 and a lower die 29. The upper die 28 consists of a punch plate 28 alone in the particular embodiment shown. The punch plate 28 is provided with a tapered portion 30 around its lower circumferential edge, which disengageably engages the tapered portions 21' of the clamp cylinders 26. The punch plate 28 is securely fixed to the lower side of the punch holder 11. Namely, as the clamp rods 20' are extended out horizontally, the tapered portions 21' and 30 are abutted in a wedge-like fashion against each other to hold the punch plate 28 securely on the lower side of the punch holder 11. The punch plate 28 is provided with a downwardly projecting punch portion 31 centrally on the lower side thereof.

The lower die 29 consists of a moving bolster plate 32, a die ring 33 and a die core 34. The bolster plate 32 has, on its lower side, wheels 35 which can run along the rails 17 on the die base 8 when the latter are in lifted positions. The bolster plate 32 is provided with a tapered portion 36 around the circumferential edge thereof and fixed on the die base 8 by the clamp cylinders 18. At this time, the rails 17 are in the lowered or sunken positions, so that a clearance is formed between each rail 17 and the wheels 35, and the lower side of the bolster plate 32 is in contact with the upper surface of the die base 8. The knockout rod 14 is retractably protruded into a knockout hole 37 which is formed at the center of the bolster plate 32. The die core ring 33 which is fixedly provided on the upper side of the bolster plate 32 slidably receives therein the die core 34 which is movable up and down by extension or retraction of the knockout rod 14. The upper and lower dies 28 and 29 are so positioned that the punch portion 31 of the punch plate 28 is in vertical alignment with and movable into and out of the inner periphery of the die ring 33.

As shown particularly in FIG. 1, the auxiliary station 3 has a T-shaped bed 38 which has the end of its center portion positioned contiguously to the ends of the rails 17 on the die base 8 and is provided with die setting and heating sections 5 and 6 on its opposite wings, respectively.

Paired parallel rails 40 are laid on top of the bed 38 in T-fashion, namely, on the center portion of the bed 38 in continuation from the rails 17 on the die base 8 and between the opposite wings of the bed to connect the press machine proper 2 with the die setting and heating sections 5 and 6. A turn table 41 which is provided at the junction of the T-rails 40 is rotatable to change the connection of the rails 40, thus constituting the aforementioned transfer mechanism 4 together with the respective rails and wheels.

The die setting section 5 incorporates part of the construction of the main press body 2 in a simplified form, including four guide posts 42 erected on the bed 38 and, although not shown, a crosshead fixedly mounted on top of the guide posts 42 and a punch holder vertically movable along the guide posts 42. The punch holder is connected to and driven up and down by a lift cylinder which is provided in the crosshead. The punch holder is provided with a clamp mechanism for releasably holding the upper die 28, and a clamp mechanism is also provided on the bed 38 for releasably holding the lower die 29. This die setting section assembles the upper and lower dies into a mated state. The die setting section is not limited to the construction shown and may incorporate any of known die setting machine constructions.

The heating section 6 includes a die opening mechanism 43 and a heater 44. As shown particularly in FIG. 2, the die opening mechanism 43 has a construction similar to the above-described die setting section 5, namely, a construction substantially similar to the one as described hereinbefore in connection with the press machine proper 2. More particularly, similarly to the die setting section, it includes guide posts 45, a crosshead 46, a punch holder 47, a releasing cylinder 48 and a clamp mechanism 49. A clamp mechanism may also be provided on the bed 38 of the heating section 6 if desired although it is not provided in the particular embodiment shown. These components are arranged in the same manner as described hereinbefore in connection with the press machine proper 2 and thus explanation in this regard is omitted to avoid repetition.

The heater 44 is provided with a heater base 50 placed on the bed 38 in a position proximate to the die opening mechanism 43, a table 51 vertically movable on the base 50, an arm 52 horizontally movable back and forth along the table 51, and a heating head 53 provided at the fore end of the arm 52. The heating head 53 is inserted between the upper and lower dies 28 and 29 which are split apart by the die opening mechanism 43, directing flames of gas burners which are provided on the upper and lower sides of the heating head 53.

Turning now to the operation by the above-described first embodiment of the present invention, upper and lower dies of a die set 27 are joined in the die setting section 5 in the manner well known in the art. The die set 27 with the joined upper and lower dies 28 and 29 is transferred to the heating section 6 by travel along the rails 40. In this phase of operation, the turn table 41 is in the position shown in FIG. 1, connecting the die setting section 5 with the die opening mechanism 43 of the heating section 6. This transfer to the heating section 6 can be attained simply by pushing the die set 27 with hand, causing the wheels 35 to turn on and along the rails 40. Until the die set 27 is delivered in, the die opening mechanism 43 of the heating section 6 has the punch holder 47 in a lifted position and the clamp mechanism 49 and heater 44 in the respective retracted stand-by positions. As soon as the die set 27 is completely fed into the die opening mechanism 43, the punch holder 47 is lowered by the lift cylinder 48 until it is abutted against the punch plate 28, and then the clamp rods of the clamp cylinders 49 are horizontally extended out to fix the punch plate 28 securely on the punch holder 47. In the next place, the punch holder 47 is lifted by the lift cylinder 48, separating the upper die 28 from the lower die 29. The heating head 53 is then protruded between the opened upper and lower dies 28 and 29. After this, the table 51 is lifted up or down to adjust the width of clearance between the heating head 53 and lower die 29, and then the upper die 28 is lowered to adjust the width of clearance between the upper die 28 and heating head 53 before shooting out flames therefrom. As soon as the upper and lower dies 28 and 29 reaches a predetermined temperature by the flames from the heating head 53 at the respective center portions, namely, at those portions which contact the forging material, the upper die 28 is lifted up together with the punch holder 47 and, after turning off the flames, the heating head 53 is withdrawn to a stand-by position outside the die opening mechanism 43. Then, the upper die 28 again is lowered to join the upper and lower dies 28 and 29, whereupon the clamp mechanism 49 is released and the punch holder 47 is lifted to the upper stand-by position. The released die set 27 is transferred along the rails 40 and onto the turntable 41. After revolving the turntable 41 through 90° to connect its rails 40 with the rails 40 to the press machine 2, the preheated die set 27 is transferred to and mounted on the press machine 2 to produce a forging. Of course, the temperature of the die set 27 on the press machine 2 is controlled at an appropriate level.

In order to replace the die set 27 on the press machine 2 by a fresh die set 27, the fresh die parts are set up and preheated in the die setting and heating sections 5 and 6 while a stock is forged on the press 2 by the old die set to be replaced. The old die set which is dismantled from the press machine 2 is transferred to the die setting section 5, and in its place, a fresh preheated die set 27 is transferred to the press machine 2 from the heating section 6 and clamped in position. Thus, the die set can be replaced promptly in an extremely facilitated manner, without stopping the operation of the press machine 2 over a long time period. The dismantled old die set 27 is disassembled at the die setting section 5 and stored in a suitable place until its next use.

As is clear from the foregoing description, the provision of the auxiliary station 3 with a die setting section 5 and a heating section 6 connected to a press machine 2 through a transfer means 4 greatly contributes to shortening the time required for die replacement and thus improves the operational efficiency of the press machine, coupled with the facilitated transfer of the die set 27. These effects have a far greater value particularly in a case where the die set has to be replaced frequently from one type to another for producing a variety of forgings each on a small scale. Moreover, the heating concentrated on the die portions which need heating improves the heating efficiency and the quality of the products to a significant degree, as compared with the conventional circumferential heating which is inefficient and imposes adverse thermal effects on the component parts of the press machine. Another advantage resides in that the die set is handled automatically throughout the heating operation, including the separation and reassembling of the upper and lower dies and the insertion of the heating head 53. After heating, the die parts are set up again in the initial adjusted positions ready for mounting on the press machine 2, without requiring further adjustment.

Figure 3:
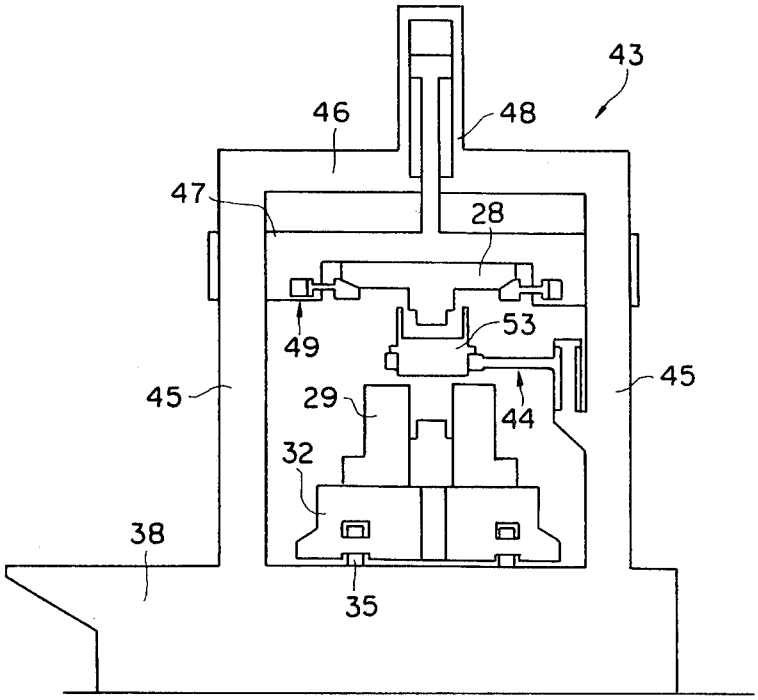
FIG. 3 is a diagrammatic sectional view of a heating section in another embodiment of the invention.

FIG. 3 illustrates a modification of the heating section 6, which is of the same construction as the above-described first embodiment except that the heater 44 is rotatably mounted on the guide posts 45 of the die opening mechanism, and in which like component parts are designated by like reference numerals.

It is to be understood that the present invention is not limited to the particular constructions shown. For example, the die setting and heating sections may be provided independently of each other, connecting them with each other and with the press machine by suitable transfer means such as roller conveyers, chain conveyers or slide ways, or automatically feeding the die set therebetween. Alternatively, a motor or other drive unit may be provided on the moving bolster plate for self-running operations to and from the die setting and heating sections and the press machine. Although the die setting and heating sections are provided separately in the foregoing embodiments, it is also possible to provide an additional heater in the die setting section if desired or to merge the heating section into the die setting section, using the same mechanism commonly for both die setting and die opening operations. Further, it is easy to make arrangement such that the whole die setting structure is moved into and out of a heater since almost all kinds of heaters are applicable in the present invention, including electric heaters, radiation heaters and high frequency heaters. The die opening mechanism may employ a screw lift instead of the lift cylinder or may be arranged to separate the upper and lower dies by lowering the lower die.

It will be appreciated from the foregoing description that, according to the present invention, the upper and lower dies of an assembled die set is opened and closed for positively heating mainly the center die portions which are actually in need of heating, thereby achieving high energy savings and heating efficiency. In addition, there is no possibility of the preheated die set thermally affecting the component parts of the press machine, so that it becomes possible for the press machine to maintain a higher accuracy and thus produce high precision products. The provision of the transfer means frees the workers from the hot and heavy labor which is involved in the transfer of the preheated die set, and drastically shortens the time of die replacement.

Thus, the die forging press according to the present invention has a number of distinctive effects in actual operations, and is advantageously applied to enhance the operational efficiency through reduction of the time of die replacements particularly in those operations where a variety of parts are produced each on a small scale as in the production of aeronautic parts.

What is claimed as new and desired to be secured by letters patent of the United States is:

1. A die forging press comprising:

(a) a plurality of die sets each of which comprises an upper die and a lower die;

(b) at least two bolster plates each of which is adapted to detachably mount one of said die sets;

(c) a press machine adapted to detachably mount one of said bolster plates during forging operations;

(d) a T-shaped bed having the end of the center portion thereof located adjacent to said press machine and the two ends of the legs of the T-shaped bed located at a distance from said press machine;

(e) a die setting section located at the end of one of the legs of said T-shaped bed, said die setting section comprising apparatus for detachably mounting one of said die sets on one of said bolster plates;

(f) a die preheating section located at the end of the other one of the legs of said T-shaped bed, said die preheating section comprising:

(i) a plurality of guide posts;

(ii) a punch holder comprising means for gripping the upper die in one of said die sets;

(iii) means for moving said punch holder vertically on said guide posts while said punch holder grips the upper die in one of said die sets, whereby said upper die is spaced from the corresponding lower die; and (iv) means for preheating the opposing faces of said one of said die sets mounted on one of said guide posts and pivotable between a stand-by position in which it is spaced from said die sets and an operational position in which it is inserted between said upper and lower dies in position to preheat said die set;

(g) a turntable located at the center of said T-shaped bed;

(h) paired parallel rails laid in and between said press machine and said turntable, in and between said die setting section and said turntable, in and between said die preheating section and said turntable, and on said turntable; and (i) a plurality of wheels mounted on said bolster plates in position to engage with said paired parallel rails for transferring said bolster plates from said die setting section to said preheating section, from said preheating section to said press machine, and from said press machine to said die setting section.

2. A die forging press as recited in claim 1 wherein the section of said paired parallel rails in said press machine includes portions which are vertically movable such that, when one of said bolster plates is standing in said press machine on said section of said paired parallel rails, said section of said paired parallel rails can be moved downwardly until the bottom of said one of said bolster plates engages a supporting surface and the wheels on said one of said bolster plates no longer engage said section of said paired parallel rails.

* * * * *